United States Patent [19]

Biederstedt et al.

[11] Patent Number: 5,033,974

[45] Date of Patent: Jul. 23, 1991

[54] PLUG CONNECTOR DEVICE FOR TELECOMMUNICATION AND DATA SYSTEMS

[75] Inventors: Lutz Biederstedt; Dieter Gerke; Markus Springer, all of Berlin, Fed. Rep. of Germany

[73] Assignee: Krone Aktiengesellschaft

[21] Appl. No.: 463,376

[22] Filed: Jan. 11, 1990

[30] Foreign Application Priority Data

Jan. 12, 1989 [DE] Fed. Rep. of Germany ..... 3900991

[51] Int. Cl.[5] ..... H01R 13/629; H01R 13/71

[52] U.S. Cl. ..... 439/265; 439/94; 439/117; 439/266

[58] Field of Search ..... 439/259, 260, 265-267, 439/296, 121, 122, 117, 94, 620-622, 709, 719; 379/327, 331, 332; 337/34

[56] References Cited

U.S. PATENT DOCUMENTS 3,588,786 6/1971 Alfiero ..... 439/265

4,871,330 10/1989 Muller et al. ..... 439/709

*Primary Examiner*—Steven C. Bishop

*Attorney, Agent, or Firm*—McGlew & Tuttle

[57] ABSTRACT

The invention relates to a plug connector device for telecommunication and data systems, comprising a plug connector 1 and a connector bank 30. The connector bank 30 is formed of a housing with insulation displacement contacts 31 connected each to switching contacts 6. The plug connector 1 comprises a housing 2 with a connector tongue 4 supported therein and has contact tracks 5 on either side which can be inserted between two switching contacts 5 opposed to each other of the connector bank 30. The exterior distance B of two contact tracks 5 being smaller than the interior distance A between two stitching contacts 6.

The plug connector 1 is provided such that there is no abrasion between the contact tracks 5 of the plug connector 1 and the switching contacts 5 of the connector bank 30 during the insert procedure. After the insert procedure, a contact connection with a sufficiently high contact force is established between the contact tracks 5 and the switching contacts 6. The contact tracks 5 of the plug connector 1 are formed as free contact strips 7 supported in the housing 2. The connector tongue 4 is mounted slidably in the housing 2 and is movable between the contacts strips 7, such that the contact strips 7 can be spread in the direction of the switching contacts 6 for establishing a contact connection.

17 Claims, 3 Drawing Sheets

PLUG CONNECTOR DEVICE FOR TELECOMMUNICATION AND DATA SYSTEMS

FIELD AND BACKGROUND OF THE INVENTION

The invention relates to a plug connector device for telecommunication and data systems including a plug connector and a connector bank. The connector bank includes cutting/clamping contact elements which are each connected to a switching contact. Opposed switching contact members form a switching contact gap. A plug connector is provided for establishing a contact connection with the switching contacts.

A plug connector of this kind is known in the art from U.S. Pat. No. 4,613,193. In this plug connector device, the plug connector comprises a connector tongue to be inserted between switching contacts. Contact tracks are provided on either side of the connector tongue. The interior distance between the two opposed switching contacts is made larger than the exterior distance of the contact tracks applied on the connector tongue. The contact connection between the switching contacts and the contact tracks is effected only shortly before the end of the insert procedure. For this purpose, there is supported slidably in the connector bank an engaging piece provided with pins. When inserting the connector tongue into the engaging piece, the switching contacts are pressed on the contact tracks by means of the pins. However, prior to the connector being inserted into its final position, such that the pins press the switching contacts on the contact tracks with a sufficient pressure force, the switching contacts will already scrape over the contact tracks of the connector. Accordingly, in the area of the contact location, an abrasion of the surface of the contact tracks will be effected, and, thus, in particular for multiple plugging actions, the electrical contact properties will be affected.

As the pins press the switching contacts from outside on the contact tracks, the distances of two pins relative to each other, for two opposed switching contacts, and relative to the longitudinal center axis must be accurately maintained in order that the switching contacts are pressed on the contact tracks under a uniform pressure force.

SUMMARY AND OBJECT OF THE INVENTION

It is an object of the invention to provide a plug connector device of the mentioned type for which the connector will not cause any abrasion during the insert action between the contact tracks of the connector and the switching contacts of the connector bank, and for which, after the insert action, a contact connection with a sufficiently high contact force between the contact tracks and the switching contact is established.

The invention provides a plug connector arrangement for telecommunications and data systems including a connector bank having a connector bank housing, wire connecting contacts positioned within the connector bank housing with each of the wire connecting contacts being connected to a switching contact. Switching contacts are disposed in opposed relationship to form switching contact pairs with each switching contact pair defining a switching contact gap. A plug connector is provided including a plug connector housing. Contact tracks are connected to the plug connector housing. The contact tracks have ends which freely extend from the housing. The contact tracks are spaced apart a distance which is smaller than the contact gap. The freely extending ends of the contact track are insertable into the connector bank housing in the switching contact gap. Contact strip adjustment means is provided including a connector tongue connected to the housing for moving the connector tracks into contact with the switching contacts to establish a contact connection.

According to the invention, the contact tracks are formed as free contact strips. Between the contact strips, a contact tongue is slidably mounted in the housing arranged movably. Advantageously, there is no connection during the insert action between the contact strips of the connector and the switching contacts of the connector bank, such that abrasion is prevented. Only after the connector is fully inserted into the connector bank, is the connector tongue is displaced for establishing a contact connection between the contact strips and the switching contacts. By this arrangement, the free ends of the contact strips are spread outwardly until they come to rest against the switching contacts under a corresponding pressure force and establish a safe contact connection. The contact force is s high that potentially existing corrosion layers on the contact strips or on the switching contacts, respectively are pierced through. For pulling the connector out, first the connector tongue is displaced, such that the contact strips lift off from switching contacts and, thus, abrasion during pulling-out of the connector bank is prevented.

The connector tongue is advantageously provided so as to be displaceable by means of an actuating element which is disposed on the outside of the housing.

A further object of the invention is to provide a plug connector arrangement which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DETAILED DESCRIPTION OF THE PREFERRED EMBODIMENT

Figure 1:
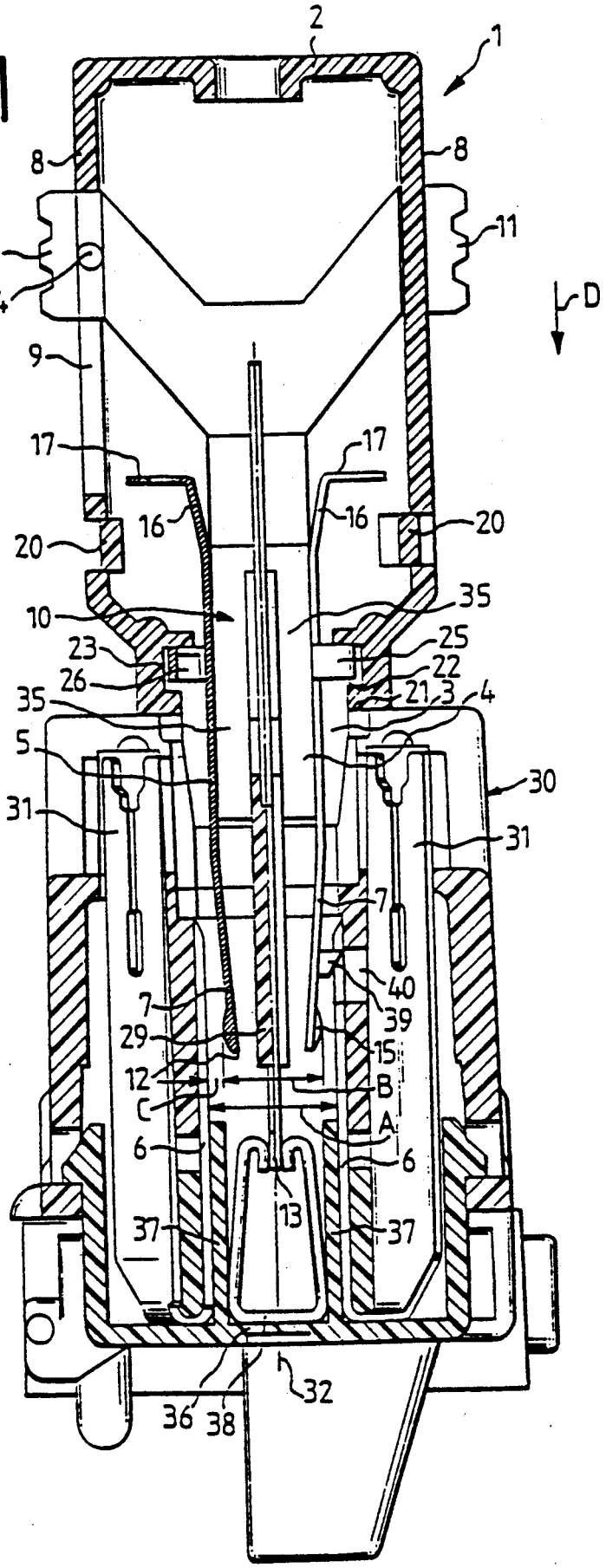
FIG. 1 is a cross-sectional view taken through a plug connector according to the invention, inserted into the connector bank before establishing a contact connection between the contact strips and the switching contacts.
Figure 2:
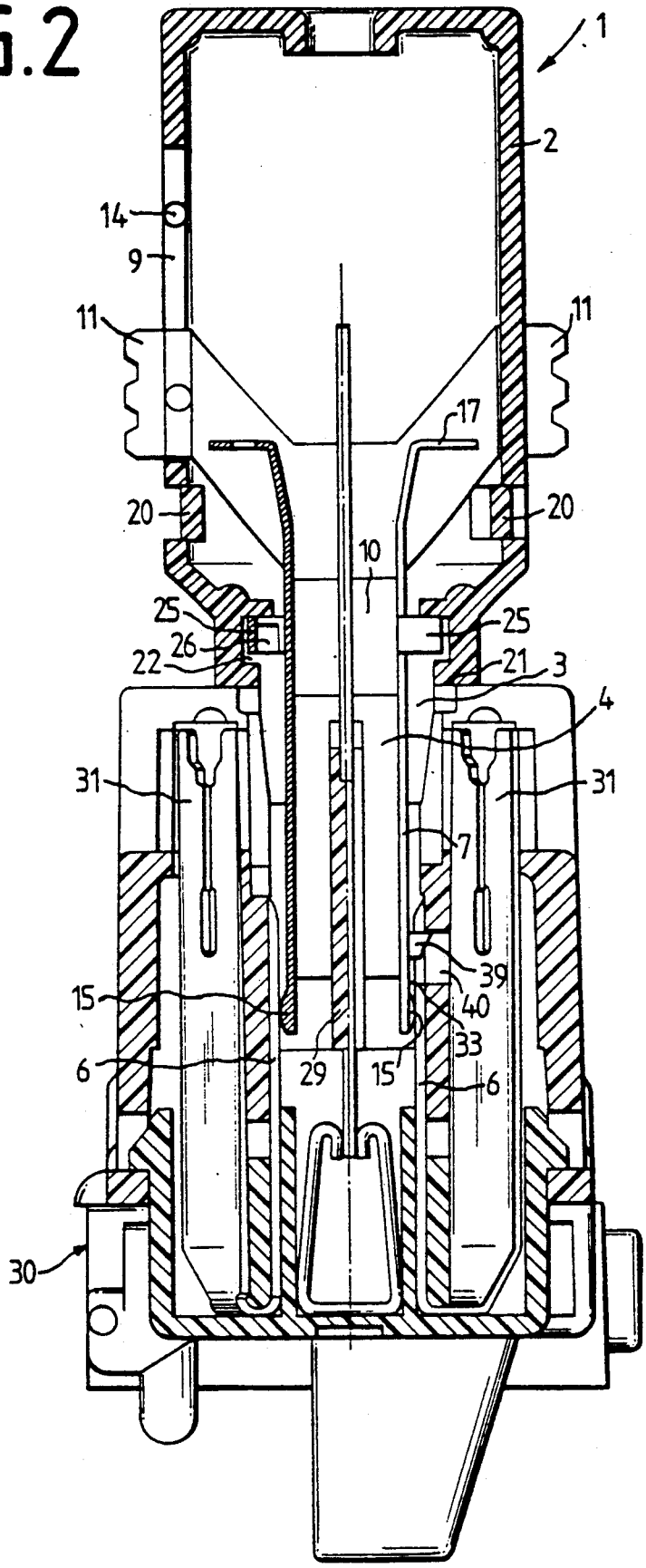
FIG. 2 is a cross-sectional view according to FIG. 2, after establishing the contact connection.

The housing 2 of the plug connector 1 comprises two identical housing halves 18, 19 made of plastic. The housing halves 18, 19 are connected over latching hooks 20. In the section of the lower front side 21 of the housing 2, there is inserted an insert piece 3 made of plastic. The insert piece 3 is provided in its upper section with a projection 22 which is inserted in a recess 23 of the housing 2.

Figure 3:
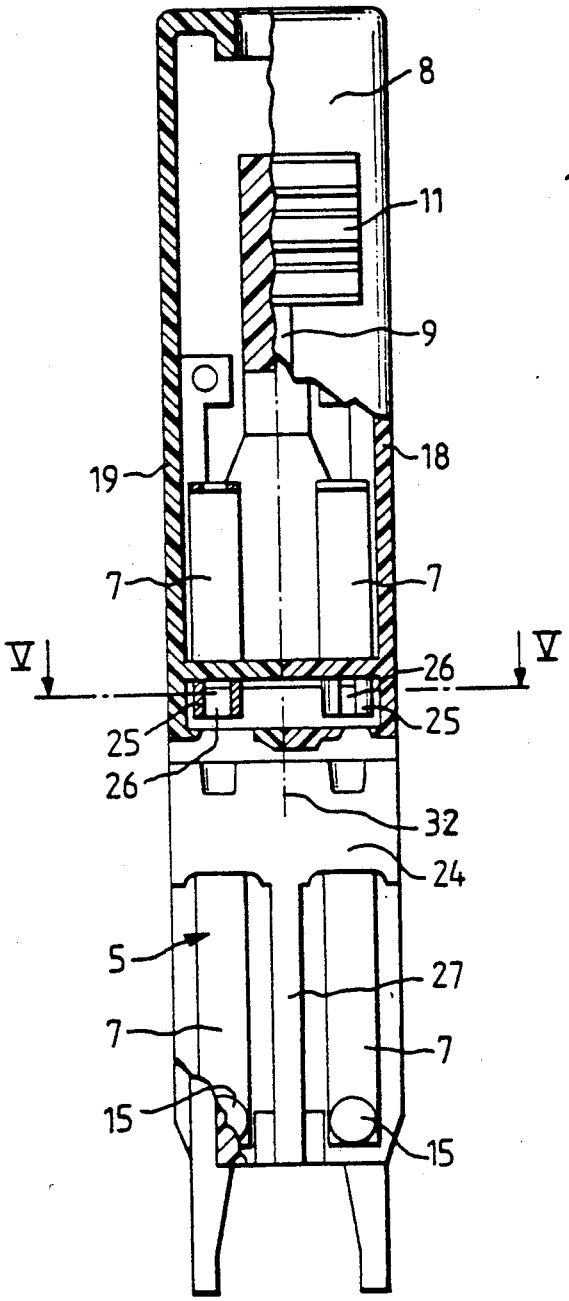
FIG. 3 is a partially sectional side view of the plug
Figure 4:
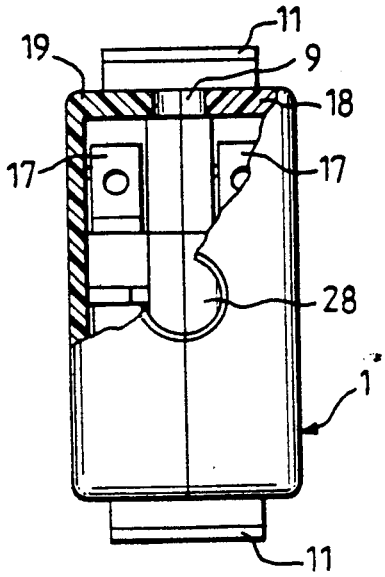
FIG. 4 is a partially sectional top view of the plug connector according to the invention; and, FIG. 5 is a sectional view taken through the plug connector according to line V—V of FIG. 3.
Figure 5:
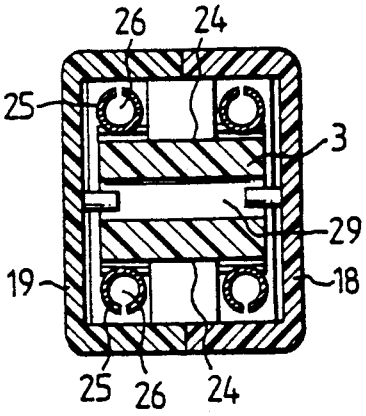

Four metal contact tracks 5 with contact strips 7 are fastened at the insert piece 3, two contact strips 7 each being disposed at the side faces 24 of the insert piece 3. The contact strips are preferably made of a copper/zinc alloy having spring-type and conductive properties. In the central section of the contact strips 7 are formed ring-type supports 25 engaging around pins 26 provided at the projection 22 of the insert 3. Both ends 12, 16 of the contact strips are, thus, freely movable, as the contact strips 7 are held in the central section only over the ring-type supports 25 at the insert piece 3 and thus at the housing 2. Two contact strips 7 disposed on a side face 24 of the insert piece are held spaced by means of a central piece 27 (FIG. 3). At a central piece 27 is arranged an elastic latching hook 39. The inner free ends 16 of the contact strips 7 are provided in the interior of the housing 2 with connection positions 17 for conductors (not shown) to be introduced through an upper housing opening 2. The outer free ends of the contact strips 7 are bent off toward the longitudinal center axis 32 of the plug connector 1 in the direction of a separating piece 29 of the insert piece 3. The outer ends 12 are provided at the outside faces 33 with contact positions 15.

In the housing 2 of the plug connector 1, there is further inserted a connector tongue 4 consisting of a plastic body, the connector tongue comprising a fork-type slide member 10 with two actuating elements 11 formed at the top side 34 thereof. The connector tongue 4 is displaceably mounted in the housing 2 of the plug connector 1 and is movable between the contact strips. The separating piece 29 of the insert piece 3 serves as a guide member for the fork-type section of the slide member 10, the legs 35 of which rest on either side against the separating piece 29 of the insert piece 3. The legs 35 of the fork-type slide member 10 are, thus, displaceably disposed between the separating piece 29 and the contact strips 7 resting in spring-type manner on the outside against the legs 35 of the slide member 10. The actuating elements 11 are guided in longitudinal slots 9 arranged at the side faces 8 of the housing 2. By means of two locking devices 14 arranged in the longitudinal slots 9, the actuating element 11 and thus the connector tongue 4 is locked in two end positions. The connector tongue 4 is, thus, displaceable on the longitudinal center axis 32 of the plug connector 1, two positions being capable to act as locking positions. The housing 2 has an upper opening 28.

The plug connector 1 can be inserted into a connector bank generally designated 30 known in the art. Such a connector bank is described substantially in U.S. Pat. No. 4,283,103 which is hereby incorporated by reference. In this connector bank 30 there are provided insulation displacement contacts 31, two of these insulation displacement contacts each being connected to two switching contacts 6. The switching contacts 6 are formed as flat, strip-type contact elements being stationarily supported in the connector bank 30 and being arranged in parallel to each other in opposed relationship to form a switching contact gap of a distance A. This interior distance A is larger than the exterior distance B of the contact strips 7 in the rest position (FIG. 1), such that when inserting the plug connector 1 into the connector bank 30, the contact strips 7 are disposed or moved to a distance C to the switching contacts 6, and can, thus, be inserted in abrasion-free manner.

This distance C is only bridged or the contact connection between the switching contacts 6 and the contact strips is only established, respectively, after the plug connector is inserted into the connector bank 30.

For establishing the contact connection, the connector tongue is slid downwardly over the actuating elements 11 in direction of the arrow D. The free outer inner ends 12 of the contact strips 7 bent off outwardly toward the separating piece 29 are spread, until the two crimps 15 of the contact strips 7 are pressed against the two switching contacts 6 under a pressure force. The electrical connection of the conductors connected to the connection positions 17 of the contact strips 7 in the housing 2 of the plug connector 1 to the insulation displacement contacts 31 of the connector bank 30 is thus established. By the displacement of the connector tongue 4, simultaneously the elastic latching hook 39 is pressed into an opening 40 of the connector bank 30, thus the plug connector 1 is locked to the connector bank 30.

For pulling the plug connector 1 out, first the contact connection between the switching contacts 6 and the contact strips 7 is interrupted by displacing the connector tongue 4 upwardly, in the direction opposite to arrow D, over the actuating elements 11. This results in connector tongue 4 releasing the contact strips 7 which, under spring action, move in the direction of the longitudinal center axis 32, such that the contact strips 7 lift off from the switching contacts 6. The plug connector 1 can now be pulled out from the connector bank 30, without abrasion taking place between the contact strips 7 and the switching contacts 6. When pulling the plug connector 1 out, the latching hook 39 will move to the original position as the connector tongue 4 is displaced in the direction opposite to the arrow D. The return occurs because of the spring action, thereby releasing the locking connection between plug connector 1 and connector bank 30.

An earthing contact 13 may be inserted from above into the earthing rail 38 at the bottom side 36, fastened to the insert piece 3 of the plug connector 1 and connected to a terminal (not shown) for an earthing cable. The earthing rail 38 is positioned between separating walls 37.

While specific embodiments of the invention have been shown and described in detail to illustrate the application of the principles of the invention, it will be understood that the invention may be embodied otherwise without departing from such principles.

What is claimed is:

1. A plug connector arrangement for telecommunication and data systems comprising:

a connector bank including a connector bank housing, wire connecting contacts positioned within said connector bank housing, each of said wire connecting contacts being connected to switching contacts, said switching contacts being disposed in opposed relationship to form switching contact pairs, each switching contact pair defining a switching contact gap;

a plug connector including a plug connector housing;

contact strips connected to said plug connector housing, said contact strips each having ends freely extending from said plug connector housing, said contact strips being spaced apart a distance which is smaller than said switching contact gap, said freely extending contact strip ends being insertable into said connector bank housing in said switching contact gap; and, contact strip adjustment means connected to said housing, for moving said contact strips into contact with said switching contacts to establish a contact connection.

2. A plug connector arrangement according to claim 1, wherein said contact strip adjustment means includes a connector tongue mounted slidably in said plug connector housing, said connector tongue being movable between said contact strips such that said contact strips ma be spread in the direction of said switching contacts.

3. A plug connector arrangement according to claim 2, wherein said connector tongue is formed as a slide member connected to actuating elements, said actuating elements being guided in longitudinal slots provided in side faces of said plug connector housing, said actuating elements being accessible from outside said plug connector housing.

4. A plug connector arrangement according to claim 2, wherein said contact strips are arranged and connected to an insert piece, said insert piece being fastened in said housing.

5. A plug connector device according to claim 2, further comprising actuating elements connected to said connector tongue for moving said connector tongue and locking elements for holding said connector tongue in one of an upper and a lower end position.

6. A plug connector arrangement according to claim 2, wherein said contact strips are bent inwardly in the direction of a longitudinal center axis of said plug connector housing, such that inner sides of said contact strips rest in a spring-type manner against an outer side of said connector tongue.

7. A plug connector device according to claim 1, wherein each contact strip includes a crimp portion arranged as a contact location at an end of said contact strip.

8. A plug connector arrangement according to claim 1, wherein each contact strip includes a connection portion for connection with conductors in the interior of said plug connector housing.

9. A plug connector arrangement according to claim 4, wherein an earth contact is provided insertable into a U-shaped earthing rail of said connector bank.

10. A plug connector arrangement according to claim 4, wherein an elastic matching hook is provided adjacent an insert piece of said plug connector, said latching hook being movable by said connector tongue to lock said latching hook in an opening provided in said connector bank to establish a locking connection of said plug connector and said connector bank.

11. A plug connector arrangement according to claim 2, wherein said switching contacts of said connector bank are formed as flat, strip-type contact elements, each of said switching contacts being stationarily supported in said connector bank arranged in parallel to define said switching contact gap.

12. A plug connector arrangement according to claim 2, wherein a U-shaped earthing rail is positioned within said connector bank housing on a bottom side of said connector bank housing, positioned between separating walls of said connector bank housing, said earthing rail extending in a longitudinal direction of said connector bank.

13. A plug connector arrangement for telecommunication and data systems comprising:

a connector bank including a connector bank housing, wire connecting contacts positioned within said connector bank housing, each of said wire connecting contacts being connected to switching contacts, said switching contacts being disposed in opposed relationship to form switching contact pairs, each switching contact pair defining a switching contact gap;

a plug connector including a plug connector housing;

contact strips connected to said plug connector housing, said contact strips each having ends freely extending from said plug connector housing, said contact strips being formed of metal and being bent inwardly to define a predetermined gap at said freely extending ends such that said ends are spaced apart a distance which is smaller than said switching contact gap, said freely extending contact strip ends being insertable into said connector bank housing in said switching contact gap; and, contact strip adjustment means connected to said housing, said contact strip adjusting means including a connector tongue mounted slidably in said plug connector housing and engaging said contacts strips within said housing for moving said contact strips into contact with said switching contacts to establish a contact connection.

14. A plug connector arrangement for telecommunication and data systems comprising:

a connector bank including a connector bank housing, wire connecting contacts positioned within said connector bank housing, each of said wire connecting contacts being connected to switching contacts, said switching contacts being disposed in opposed relationship to form switching contact pairs, each switching contact pair defining a switching contact gap;

a plug connector including a plug connector housing;

contact strips connected to said plug connector housing, said contact strips each having ends freely extending from said plug connector housing, said contact strips being spaced apart a distance which is smaller than said switching contact gap, said freely extending contact strip ends being insertable into said connector bank housing in said switching contact gap; and, contact strip adjustment means connected to said housing, for moving said contact strips into contact with said switching contacts to establish a contact connection, said contact strip adjustment means including a connector tongue mounted slidably in said plug connector housing, said connector tongue being movable between said contact strips such that said contact strips may be spread in the direction of said switching contacts, said contact strips being arranged and connected to an insert piece, said insert piece being fastened in said housing.

15. A plug connector arrangement for telecommunication and data systems comprising:

a connector bank including a connector bank housing, wire connecting contacts positioned within said connector bank housing, each of said wire connecting contacts being connected to switching contacts, said switching contacts being disposed in opposed relationship to form switching contact pairs, each switching contact pair defining a switching contact gap;

a plug connector including a plug connector housing;

contact strips connected to said plug connector housing, said contact strips each having ends freely extending from said plug connector housing, said contact strips being spaced apart a distance which is smaller than said switching contact gap, said freely extending contact strip ends being insertable into said connector bank housing in said switching contact gap; and, contact strip adjustment means connected to said housing, for moving said contact strips into contact with said switching contacts to establish a contact connection, said contact strip adjustment means includes a connector tongue mounted slidably in said plug connector housing, said connector tongue being movable between said contact strips such that said contact strips may be spread in the direction of said switching contacts, said contact strips being bent inwardly in the direction of a longitudinal center axis of said plug connector housing, such that inner sides of said contact strips rest in a spring-type manner against an outer side of said connector tongue.

16. A plug connector arrangement for telecommunication and data systems comprising:

a connector bank including a connector bank housing, wire connecting contacts positioned within said connector bank housing, each of said wire connecting contacts being connected to switching contacts, said switching contacts being disposed in opposed relationship to form switching contact pairs, each switching contact pair defining a switching contact gap;

a plug connector including a plug connector housing;

contact strips connected to said plug connector housing, said contact strips each having ends freely extending from said plug connector housing, said contact strips being spaced apart a distance which is smaller than said switching contact gap, said freely extending contact strip ends being insertable into said connector bank housing in said switching contact gap; and, contact strip adjustment means connected to said housing, for moving said contact strips into contact with said switching contacts to establish a contact connection, each contact strip including a crimp portion arranged as a contact location at an end of said contact strip.

17. A plug connector arrangement for telecommunication and data systems comprising:

a connector bank including a connector bank housing, wire connecting contacts positioned within said connector bank housing, each of said wire connecting contacts being connected to switching contacts, said switching contacts being disposed in opposed relationship to form switching contact pairs, each switching contact pair defining a switching contact gap;

a plug connector including a plug connector housing;

contact strips connected to said plug connector housing, said contact strips each having ends freely extending from said plug connector housing, said contact strips being spaced apart a distance which is smaller than said switching contact gap, said freely extending contact strip ends being insertable into said connector bank housing in said switching contact gap; and, contact strip adjustment means connected to said housing, for moving said contact strips into contact with said switching contacts to establish a contact connection, said connector tongue is formed as a slide member connected to actuating elements, said actuating elements being guided in longitudinal slots provided in side faces of said plug connector housing, said actuating elements being accessible from outside said plug connector housing.

* * * * *